US006967576B2

(12) United States Patent
Hayes et al.

(10) Patent No.: US 6,967,576 B2
(45) Date of Patent: Nov. 22, 2005

(54) ITEM LOCATION TRACKING SYSTEM AND METHOD

(75) Inventors: David J. Hayes, Lake Worth, FL (US); Joseph L. Dvorak, Bocan Raton, FL (US)

(73) Assignee: Motorola, Inc., Schaumburg, IL (US)

( * ) Notice: Subject to any disclaimer, the term of this patent is extended or adjusted under 35 U.S.C. 154(b) by 32 days.

(21) Appl. No.: 10/603,715

(22) Filed: Jun. 25, 2003

(65) Prior Publication Data

US 2004/0263327 A1 Dec. 30, 2004

(51) Int. Cl.[7] ..... G08B 13/14
(52) U.S. Cl. ..... 340/572.1; 340/573.1; 340/539.15
(58) Field of Search ..... 340/573.1, 568.1, 340/572.1, 825.36, 825.49, 539.1, 539.13, 539.15, 539.11, 525.36

(56) References Cited

U.S. PATENT DOCUMENTS 6,002,334 A 12/1999 Dvorak
6,078,282 A 6/2000 Casey
6,331,817 B1 12/2001 Goldberg
6,366,202 B1 4/2002 Rosenthal
6,501,378 B1 12/2002 Knaven
2003/0011478 A1 * 1/2003 Rabanne et al. ..... 340/573.4
2003/0218539 A1 * 11/2003 Hight ..... 340/539.13

* cited by examiner

*Primary Examiner*—Julie Bichngoc Lieu

(57) ABSTRACT

Disclosed is a system, method, and computer program product for tracking at least one item. The method on a device includes determining a location of the device and determining whether the location of the device is within a predefined area. The method further includes determining whether the at least one item is within a range. If the at least one item is not within the range and if the location of the device is not within the predefined area, the location of the device is stored. If the device is operating in active mode, an alarm is sounded indicating that the at least one item is not within the range.

24 Claims, 7 Drawing Sheets

ITEM LOCATION TRACKING SYSTEM AND METHOD

FIELD OF THE INVENTION

The present invention generally relates to the field of wireless devices, and more particularly relates to item location tracking using a wireless device.

BACKGROUND OF THE INVENTION

Small consumer electronic devices have enjoyed increasing popularity in recent years. The 1990s has seen the wide acceptance and use of wireless devices, mobile telephones, messaging devices, pagers, laptops, palmtops, handheld computers and PDAs. Today, business people, students and individuals routinely leave home with a variety of expensive and electronic devices, as well as conventional items such as a wallet, keys and personal organizer. Because individuals today travel to work, home and school with so many items, the loss of an item is common. This can be devastating to an individual who stored important information in a wireless device or who depends on an item, such as keys, to perform his duties.

One solution to this problem describes a hub that remains with a user and electronic beacon emitters, or electronic markers, which are coupled to each item. The electronic markers transmit beacon packets to the hub, which keeps track of the electronic markers. While electronic markers are within range of the hub such that the hub is able to receive beacon packets from the electronic markers, the hub is assured that the electronic marker, and the coupled item, is traveling with or in the possession of the user. When an electronic marker goes out of range of the hub such that the hub is not able to receive beacon packets from the electronic markers, the hub determines that the electronic marker, and the coupled item, is not traveling with or in the possession of the user. Subsequently, the hub sounds an alarm or other indicator to inform the user that the electronic marker and the coupled item are not with the user.

This solution, however, does not come without its drawbacks. The simplified alarm scheme described above can be annoying when a user is in a safe area such as his-work office or at home. When a user is at home, for example, he may desire to put down an item and not be bothered with it. In this case, an alarm is not warranted. In another example, a user may desire not to be bothered with alarms during certain periods of time such as during work hours on weekdays. Alarms can be disruptive and distracting while a user is working.

In another example, a user may desire to couple to an item only in certain conditions. An electronic marker is considered coupled to the hub when it is determined that a user desires to travel or move with the electronic marker and does not want to be separated from or lose the electronic marker. Typically, coupling occurs when a hub encounters an electronic marker, or when an electronic marker comes into range of the hub. However, a user may not desire to have the hub couple to an electronic marker each time the hub encounters the electronic marker. For example, when a user is at home or at the office, the user may not desire to have the hub couple to an electronic marker each time the hub encounters the electronic marker.

Therefore a need exists to overcome the problems with the prior art as discussed above.

SUMMARY OF THE INVENTION

Briefly, in accordance with the present invention, disclosed is a system, method, and computer program product for tracking at least one item. The method on a wireless device includes determining a location of the wireless device and determining whether the location of the wireless device is within a predefined area. The method further includes determining whether at least one item is within a range. If at least one item is not within the range and if the location of the wireless device is not within the predefined area, the location of the wireless device is stored. If the wireless device is operating in active mode, an alarm is sounded or other notification including vibrating or flashing lights, indicating that at least one item is not within the range.

In another embodiment of the present invention, the method further includes determining whether the current time is within a predefined time period. If the current time is not within the predefined time period, an alarm is sounded indicating that at least one item is not within the range.

In yet another embodiment of the present invention, the method on a wireless device includes continuously determining a location of the wireless device and detecting that at least one item has come within a range. The method further includes determining from the location of the wireless device that the wireless device is moving and determining that at least one item is moving within the range of the wireless device. The method further includes determining whether at least one item has moved within the range of the wireless device for a predefined period of time or for a predefined distance. If so, a variable is set indicating that at least one item is attached to the wireless device.

In yet another embodiment of the present invention a wireless device for tracking at least one item is disclosed. The wireless device includes a location module for determining a location of the wireless device and a receiver for receiving signals from at least one item. The wireless device further includes location information for a predefined area and a processor for determining whether the location of the wireless device is within the predefined area and determining whether at least one item is within a range. The wireless device further includes a storage module for storing the location of the wireless device if at least one item is not within the range and if the location of the wireless device is not within the predefined area.

DETAILED DESCRIPTION

The present invention, according to a preferred embodiment, overcomes problems with the prior art by providing advanced customization features with regards to storing item location data and initiating alarms or other notification including vibrating or flashing lights.

Figure 1:
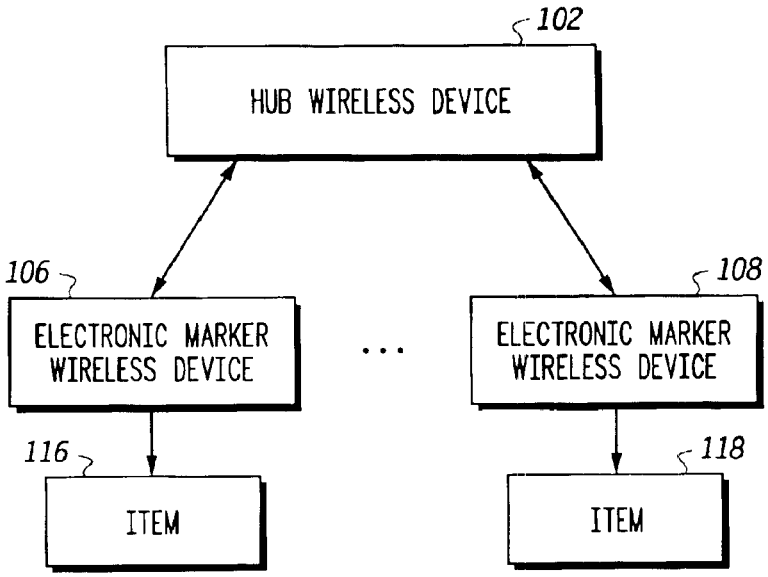
FIG. 1 is a block diagram illustrating an item location tracking system, in one embodiment of the present invention.

FIG. 1 is a block diagram illustrating an item location tracking system, in one embodiment of the present invention. The exemplary item location tracking system of FIG. 1 includes a hub 102 and/or electronic markers 106 through 108, which are either detachably coupled to items 116 through 118 or embedded into items 116 through 118. The hub 102 supports any number of electronic markers 106 through 108. The teachings of U.S. Pat. No. 6,002,334, with inventor Joseph L. Dvorak entitled "Automated Item Coupling System and Method Therefor", issued Dec. 14, 1999, is hereby incorporated by reference in its entirety.

Hub 102 is a radio-enabled central point for electronic markers 106 through 108. In one embodiment, the hub 102 is a wireless access point complying with the IEEE 802.11 (b) wireless communication standard. An example of such a wireless access point is the Microsoft Broadband Networking Wireless Base Station available from Microsoft Corporation of Redmond, Wash. In another embodiment, the hub 102 is a wireless telephone with wireless connectivity complying with the IEEE 802.15.4 wireless communication standard. In yet another embodiment, the hub 102 is a wireless access point complying with the Bluetooth wireless communication standard.

Figure 2:
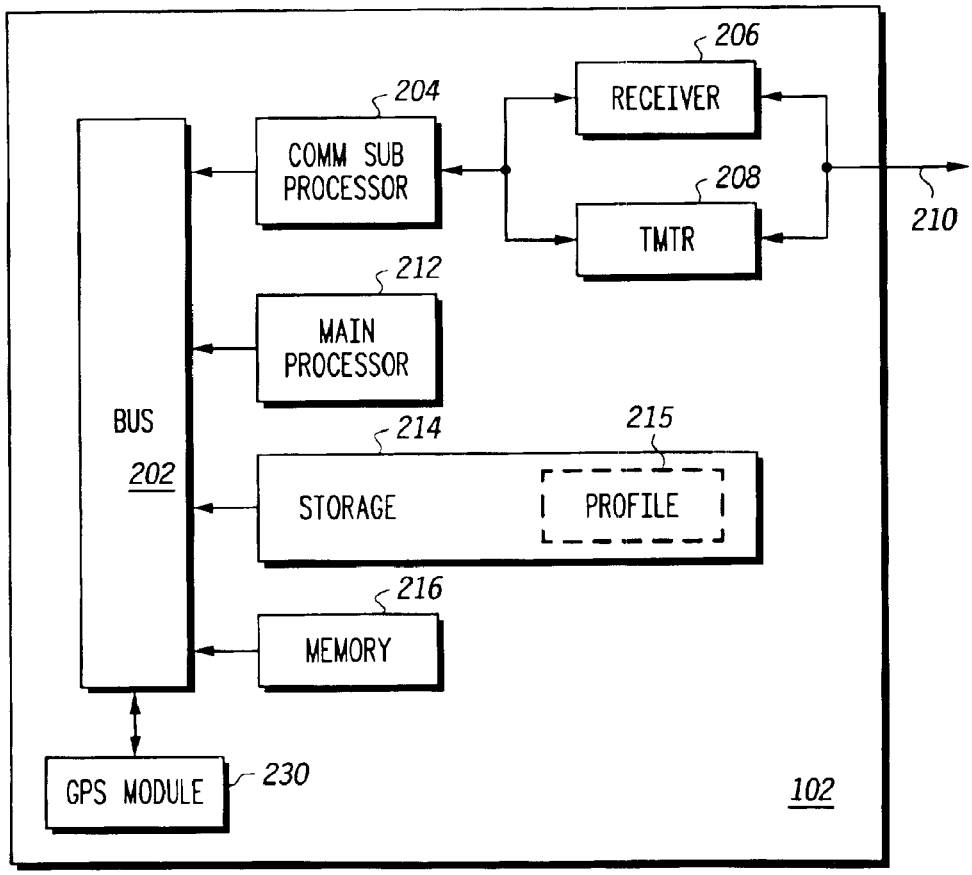
FIG. 2 is a more detailed block diagram of a hub in the item location tracking system of FIG. 1.
Figure 12:
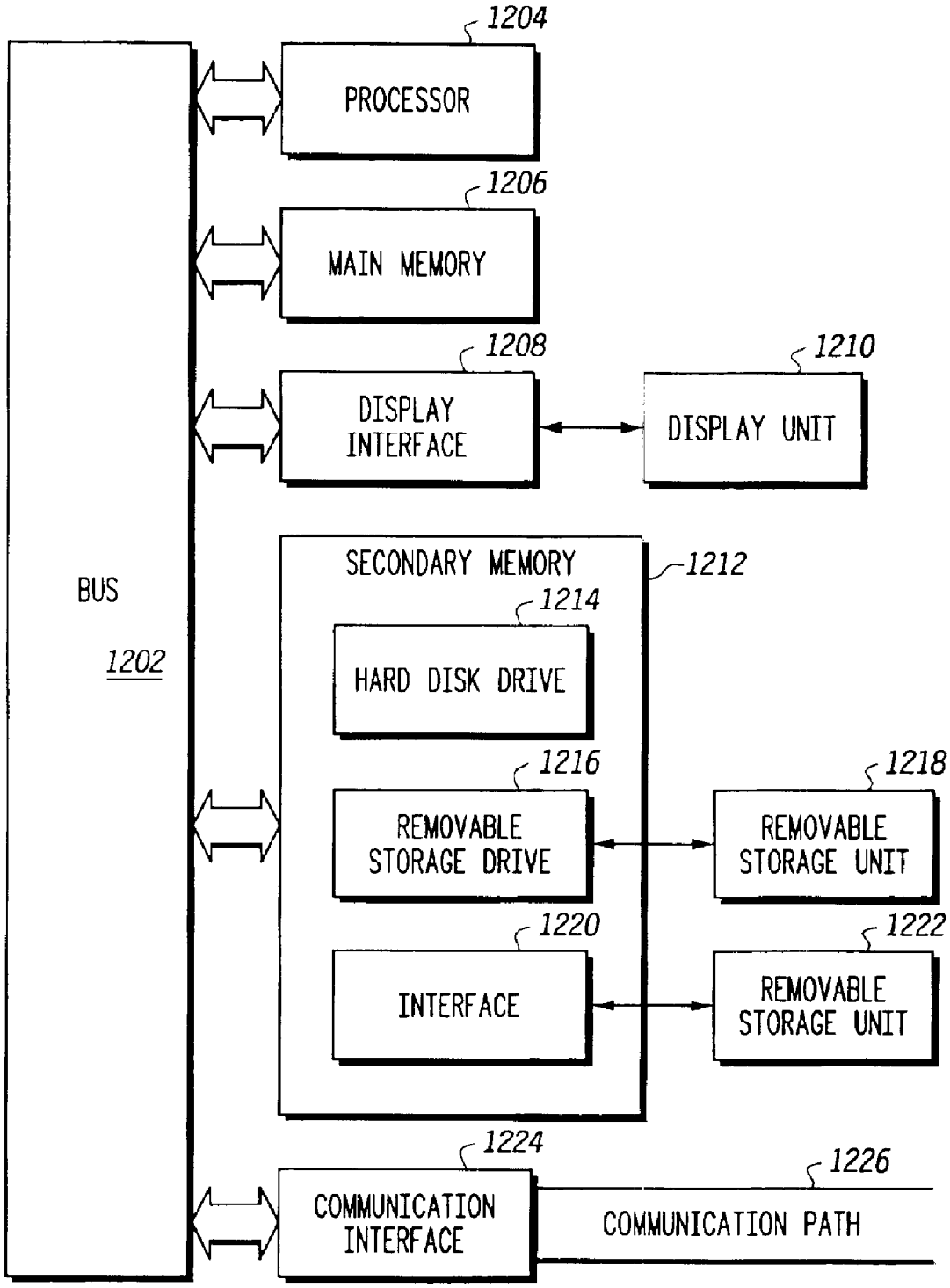
FIG. 12 is a block diagram of an information processing system useful for implementing the present invention.

In one embodiment, hub 102 and electronic markers 106 through 108 are desktop computers, laptop computers, handheld computers, palmtop computers, mobile phones, push-to-talk mobile radios, text messaging devices, two way pagers, one way pagers, or the like as described further with reference to FIGS. 2 and 12. In this embodiment, electronic markers 106 through 108 are equipped with a transmitter and an optional receiver for communicating with the hub 102 according to the appropriate wireless communication standard.

In one embodiment of the present invention, each electronic marker 106 through 108 is equipped with a wireless access portion for accessing hub 102. Electronic markers 106 through 108 are described in greater detail below.

Hub 102 can also include a wired or wireless network connection (not shown). The network connection comprises a connection to any one or any combination of a Local Area Network (LAN), a Wide Area Network (WAN), a Public Switched Telephone Network (PSTN), a dedicated line, or the like. Such a connection would provide further network access to hub 102.

Items 116 through 118 are any items for which a user may desire to keep location information, such as to prevent losing the item. Examples of such items are a wallet, keys, a purse, a backpack, a book, a laptop computer, a handheld computer, a mobile telephone and a money clip.

FIG. 2 is a more detailed block diagram of a hub 102 in the item location tracking system of FIG. 1. The hub 102 includes a receiver 206 and an optional transmitter 208 for transmitting and receiving information via wireless signals (i.e., channel 210) to and from at least one electronic marker 106 through 108. In one embodiment of the present invention, receiver 206 and transmitter 208 operate over channel 210 in accordance with the IEEE 802.11(b) wireless communication standard, the IEEE 802.15.4 wireless communication standard, the Bluetooth wireless communication standard, or other wireless communications standards including infra-red, satellite and broadcast protocols. All information sent or received via the receiver 206 and transmitter 208 is processed by a communications sub-processor 204. In another embodiment of the present invention, the hub 102 includes only receiver 206, not transmitter 208, as the hub 102 need only receive information from the electronic markers 106 through 108.

The wireless device 106 includes a main processor 212 that handles all processes associated with the receiving and transmitting functions of the hub 102. The main processor 212 also performs other functions of the hub 102, such as initiating alarms and logging location information of the electronic markers 106 through 108. This is described in greater detail below. FIG. 2 also includes a storage module 214 for storing information that may be used during the overall processes of the present invention. One group of data that may be used during the overall processes of the present invention is a profile 215. A profile 215 defines the manner in which an electronic marker 106 may be tracked, the manner in which the user of the hub 102 is informed of the location of the electronic marker 106 and other information. The profile 215 is described in greater detail below.

Hub 102 also includes a main memory module 216, such as a volatile memory element like a DRAM module or a non-volatile memory such as battery backup RAM or both. The main memory module 216 is used for storing and retrieving data and instructions necessary for performing the functions of hub 102. Communications bus 202 provides a conduit for communications between communications sub-processor 204, the main processor 212, the main storage element 214 and the main memory module 216.

FIG. 2 also shows an optional Global Positioning System (GPS) module 230 for determining location information of the hub 102. This module 230 uses the GPS satellite system to determine the location and/or velocity of the hub 102. Alternative to the GPS module 230, the hub 102 may include alternative modules for determining the location and/or velocity of hub 102, such as using cell tower triangulation and assisted GPS.

As explained above, hub 102 can also include a network connection. The network connection provides access to a network comprising any one or any combination of a LAN, a WAN, a PSTN, a dedicated line, or the like. In one embodiment, the network connection wirelessly connects the hub 102 to a network.

Figure 3:
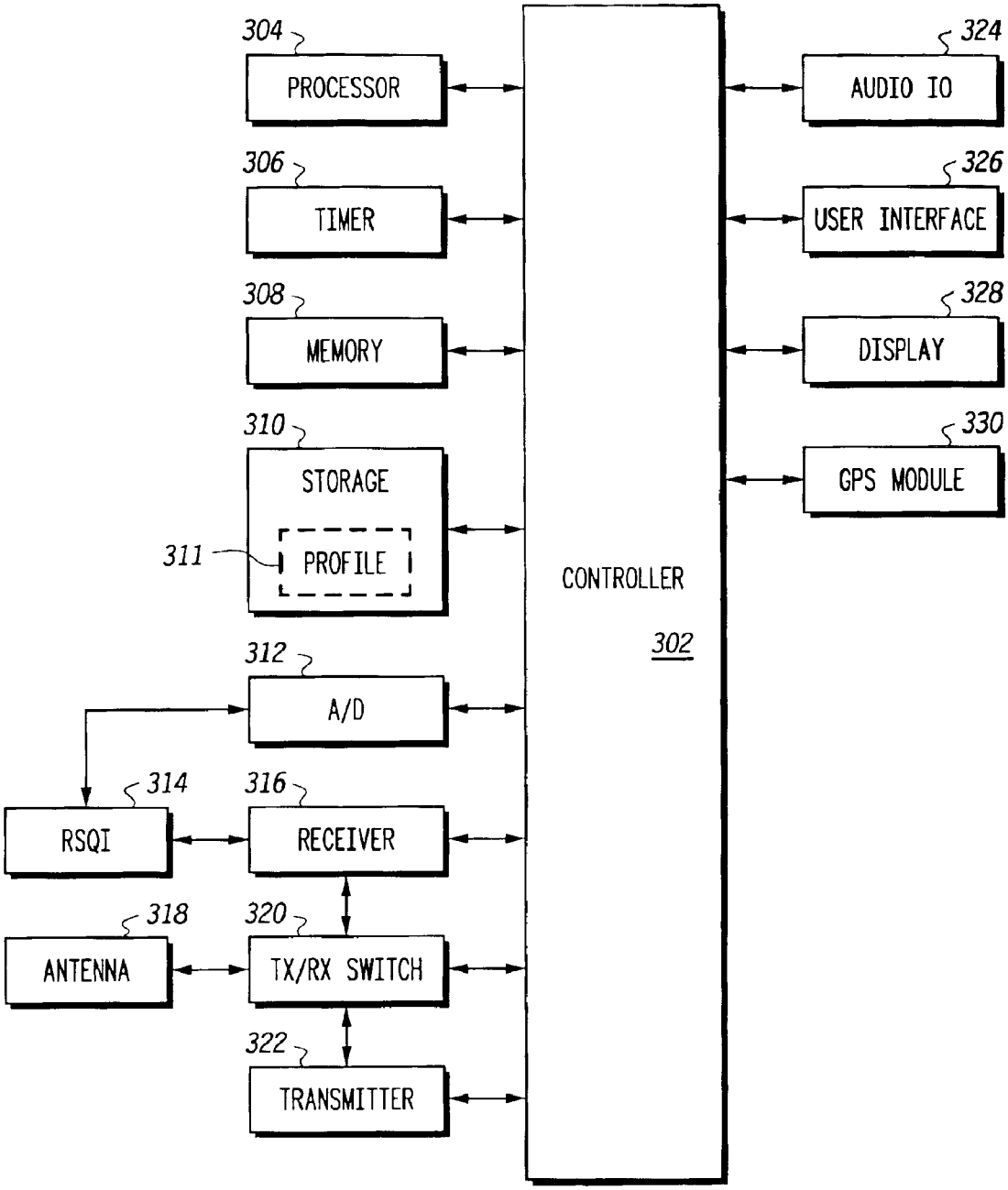
FIG. 3 is a more detailed block diagram of a wireless device used as a hub in the item location tracking system of FIG. 1.

The primary purpose of the hub 102 is to determine the location of the electronic markers 106 through 108 and to inform the user of the hub 102 of the whereabouts of the electronic markers 106 through 108. The hub 102 keeps track of the electronic markers 106 through 108 by receiving beacon information packets from the electronic markers 106 through 108 via receiver 206. Beacon information packets are described in greater detail below. The method in which the hub 102 informs the user of the hub 102 of the whereabouts of the electronic markers 106 through 108 is described in greater detail below FIG. 3 is a more detailed block diagram of a wireless device used as a hub 102 in the item location tracking system of FIG. 1. FIG. 3 shows a mobile telephone wireless device. In one embodiment of the present invention, the hub 102 is a two-way radio capable of receiving and transmitting radio frequency signals over a communication channel under a communications protocol such as Code Division Multiple Access (CDMA), Time Division Multiple Access (TDMA), Global System for Mobile Communications (GSM), General Packet Radio Service (GPRS), Frequency Division Multiple Access (FDMA) or the like.

The hub 102 operates under the control of a controller 302, which switches the hub 102 between receive and transmit modes. In receive mode, the controller 302 couples an antenna 318 through a transmit/receive switch 320 to a receiver 316. The receiver 316 decodes the received signals and provides those decoded signals to the controller 302. In transmit mode, the controller 302 couples the antenna 318, through the switch 320, to a transmitter 322.

The controller 302 operates the transmitter and receiver according to instructions stored in memory 308. These instructions include a neighbor cell measurement-scheduling algorithm. In preferred embodiments of the present invention, memory 308 comprises any one or any combination of non-volatile memory, Flash memory or Random Access Memory. A timer module 306 provides timing information to the controller 302 to keep track of timed events. Further, the controller 302 utilizes the time information from the timer module 306 to keep track of scheduling for neighbor cell server transmissions and transmitted color code information.

When a neighbor cell measurement is scheduled, the receiver 316, under the control of the controller 302, monitors neighbor cell servers and receives a "received signal quality indicator" (RSQI). An RSQI circuit 314 generates RSQI signals representing the signal quality of the signals transmitted by each monitored cell server. Each RSQI signal is converted to digital information by an analog-to-digital converter 312 and provided as input to the controller 302. Using the color code information and the associated received signal quality indicator, the hub 102 determines the most appropriate neighbor cell server to use as a primary cell server when hand-off is necessary.

Processor 304 in FIG. 3 performs various functions such as the functions attributed to the item tracking and alarm routines, as described below with reference to FIGS. 6–11. In various embodiments of the present invention, the processor 304 in FIG. 3 comprises a single processor or more than one processor for performing the tasks described below.

FIG. 3 also includes a storage module 310 for storing information that may be used during the overall processes of the present invention. One group of data that may be used during the overall processes of the present invention is a profile 311. A profile 311 defines the manner in which an electronic marker 106 may be tracked, the manner in which the user of the hub 102 is informed of the location of the electronic marker 106 and other information. The profile 311 is described in greater detail below.

In one embodiment, the wireless messaging device is a wireless telephone. For this embodiment, the hub 102 of FIG. 3 further includes an audio input/output module 324 for allowing the input of audio into the hub 102 and the output of audio for listening by a user. Also included is a user interface 326 for allowing to interact with the hub 102, such as modifying address book information, interacting with call data information and making/answering calls. Hub 102 further includes a display 328 for displaying information to the user of the mobile telephone.

FIG. 3 also shows an optional Global Positioning System (GPS) module 330 for determining location and/or velocity information of the hub 102. This module 330 uses the GPS satellite system to determine the location and/or velocity of the hub 102. Alternative to the GPS module 330, the hub 102 may include alternative modules for determining the location and/or velocity of hub 102, such as using cell tower triangulation and assisted GPS.

As explained above, the profile 215 and 311 defines the manner in which an electronic marker 106 may be tracked, the manner in which the user of the hub 102 is informed of the location of the electronic marker 106 and other information. In one embodiment, the profile 215 includes information describing a safe area using GPS coordinates (typically latitude and longitude coordinates). Alternatively, an identifier of a fixed beaconing device can designate the safe area. A safe area is an area where a user is not concerned with leaving behind an item 116. Examples of a safe area are a user's home, a user's work office and a user's friend's house.

The following is an exemplary table in the user profile 215 where each optional entry is now described.

| Item No. | Item | Location | Safe Area | Passive Active | Alarm | Schedule | Motion | Learn |
|---|---|---|---|---|---|---|---|---|
| 1 | Wallet | Office | Home | Active | Yes | Bus Hrs | Yes | No |
| 2 | Keychain | Bedroom | Home | Active | No | None | Yes | Yes |

In another embodiment, the profile 215 includes a passive/active status indicator. This indicator describes whether the user desires to have an active or passive alarm that shall be activated when an electronic marker 106 goes out of range. Examples of an active alarm are an audible alarm, a tactile alarm such as a vibration mode, or a visual alarm such as a blinking light. One example of a passive alarm is the logging of location information of an electronic marker 106. This is described in greater detail below.

In yet another embodiment, the profile 215 includes an indicator that defines a passive/active status indicator coupled with safe area information. That is, a user may define a particular status in certain areas. For example, a user may define passive status is when the hub 102 is a safe area and define active status when the hub 102 is not in a safe area.

In yet another embodiment, the profile 215 includes schedule based alarm status information. That is, the user may define a particular status during certain times of the day or week. For example, a user may define passive status during weekday work hours and define active status otherwise.

In yet another embodiment, the profile 215 includes motion based coupling information. This describes how the hub 102 couples to an electronic marker 106 using motion.

An electronic marker 106 is considered coupled to the hub 102 when it is determined that a user desires to travel or move with the electronic marker and does not want to be separated from or lose the electronic marker. When the user of the hub 102 has picked up the electronic marker 106 and has started to move with it, the hub 102 determines whether the electronic marker 106 has moved a predefined distance or a predefined time with hub 102. Based on this determination, the hub 102 determines whether to couple to the electronic marker 106. This is described in greater detail below.

In yet another embodiment, the profile 215 includes learning mode information. This describes how the hub 102 automatically learns to track items, alarm the user of items gone out of range and couple to electronic markers. Learning mode typically occurs upon first use or upon resetting of the configuration of the hub 102. The learning mode indicates to the hub 102 that it must log item location information and coupling information for a period of time in order to learn the habits of the user. After a period of time, the learning mode of the hub 102 expires and the hub 102 enters normal operating mode in step 1108 of FIG. 11, which is described in greater detail below. Alternatively, the hub 102 enters normal operating mode by prompting the user. This is described in greater detail below.

Figure 4:
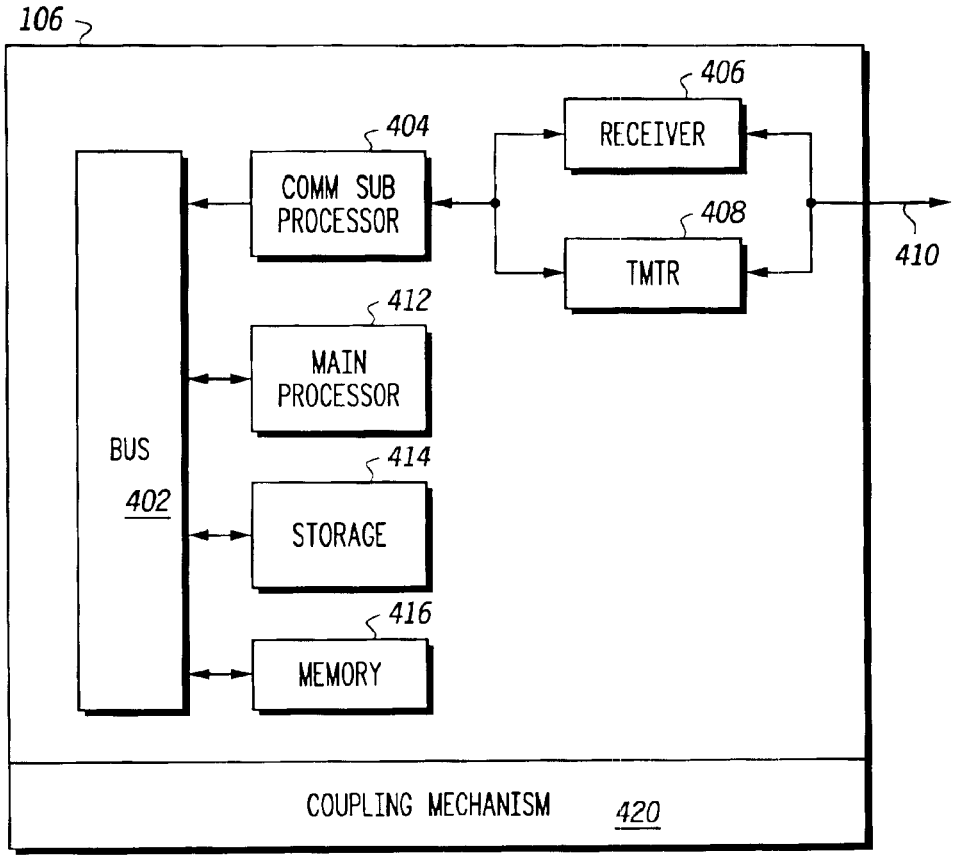
FIG. 4 is a more detailed block diagram of an electronic marker in the item location tracking system of FIG. 1.

FIG. 4 is a more detailed block diagram of an electronic marker 106 in the item location tracking system of FIG. 1. The electronic marker 106 includes an optional receiver 406 and a transmitter 408 for transmitting and receiving information via radio signals (i.e., channel 410) to and from hub 102. In one embodiment of the present invention, receiver 406 and transmitter 408 operate over channel 410 in accordance with the IEEE 802.11(b) wireless communication standard, the IEEE 802.15.4 wireless communication standard, the Bluetooth wireless communication standard and other or other wireless communications standards including infra-red, satellite and broadcast protocols. All information sent or received via the receiver 406 and transmitter 408 is processed by a communications sub-processor 404. In another embodiment of the present invention, the electronic marker 106 includes only transmitter 408, not receiver 406, as the electronic marker 106 needs only to transmit information (i.e., beacon packets) to hub 102.

The electronic marker 106 includes a main processor 412 that handles all processes associated with the receiving and transmitting functions of the electronic marker 106. The main processor 412 also performs other functions of the electronic marker 106, such as initiating sleep mode or indicating a low battery setting. FIG. 4 also includes a storage module 414 for storing information that may be used during the overall processes of the present invention.

Electronic marker 106 also includes a main memory module 416, such as a volatile memory element like a DRAM module or a non-volatile memory such as battery backup RAM or both. The main memory module 416 is used for storing and retrieving data and instructions necessary for performing the functions of electronic marker 106. Communications bus 402 provides a conduit for communications between communications sub processor 404, the main processor 412, the main storage element 414 and the main memory module 416.

Lastly, the electronic marker 106 optionally includes a coupling mechanism 420 for detachably coupling the electronic marker 106 to an item 116, which is any item for which a user may desire to keep location information, such as to prevent losing the item. Examples of such items are a wallet, keys, a purse, a backpack, a book, a laptop computer, a handheld computer, a mobile telephone and a money clip. The coupling mechanism 420 is a clip, a hook, a holster, a pin, a key ring, a draw cord, loop, a magnetic holster or the like.

The main function of the electronic marker 106 is to be coupled with or embedded in an item 116 using the coupling mechanism 420 and to transmit information indicating its location. This can be accomplished by transmitting a beacon information packet via the transmitter 408 over channel 410 to the hub 102 at a low power such that reception of the beacon information packet indicates proximity. A beacon information packet from electronic marker 106 informs the hub 102 that the electronic marker 106 is within radio range of the hub 102. In one embodiment of the present invention, the electronic marker 106 periodically transmits a beacon information packet to the hub 102, the beacon information packet including a unique identifier corresponding to the electronic marker 106. Alternatively, the electronic marker's absolute location or location relative to a reference can be determined by the electronic marker and transmitted (directly or indirectly) to the hub.

In one embodiment of the present invention, the electronic marker 106 includes an optional Global Positioning System (GPS) module (such as module 230 of FIG. 2) for determining location information of the electronic marker 106. This module uses the GPS satellite system to determine the location and/or velocity of the electronic marker 106. Alternative to the GPS module, the electronic marker 106 may include alternative modules for determining the location and/or velocity of electronic marker 106, such as using cell tower triangulation and assisted GPS. In this embodiment, the electronic marker 106 can transmit its location to a hub 102 or to other electronic markers 106 and, conversely, receive the location of other electronic markers 106 and of hub 102.

Figure 5:
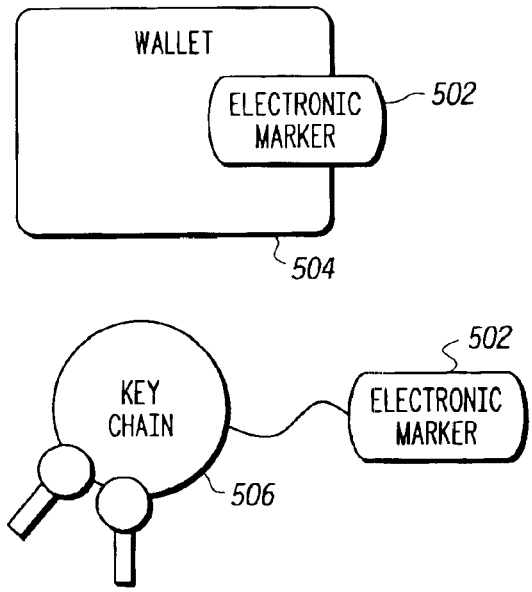
FIG. 5 is an illustration of electronic markers coupled to items, in one embodiment of the present invention.

FIG. 5 is an illustration of electronic markers coupled to items, in one embodiment of the present invention. FIG. 5 shows an electronic marker 502 coupled to a wallet 504. In this embodiment, the electronic marker 502 is coupled to the wallet 504 using a coupling mechanism 420 consisting of a clip. FIG. 5 also shows an electronic marker 502 coupled to a key chain 506. In this embodiment, the electronic marker 502 is coupled to the key chain 506 using a coupling mechanism 420 consisting of a key ring, draw cord or other device for coupling to another key ring.

The following exemplary flow diagram in FIGS. 6–11 describe how the electronic markers 106–108 along with the hub 102 and especially the profile 311 in the hub 102 are used in several embodiments of the present invention.

Figure 6:
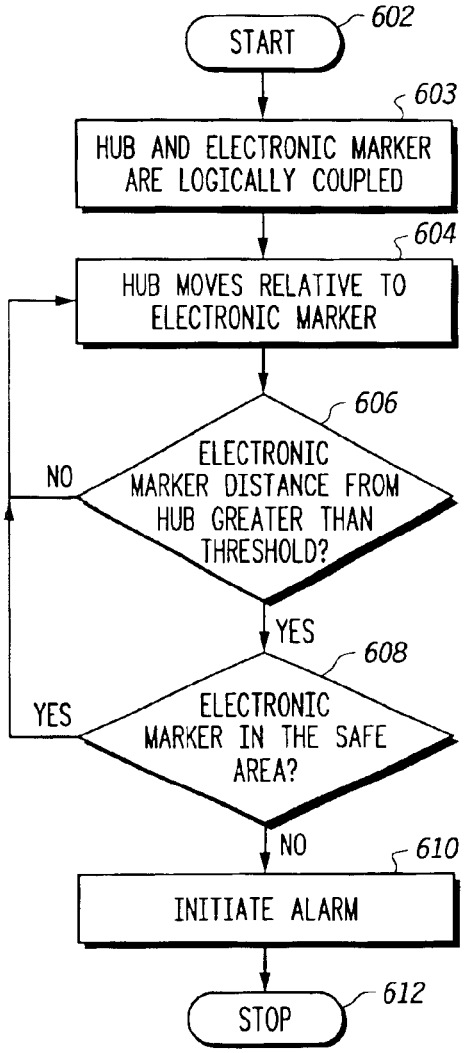
FIG. 6 is an operational flow diagram showing a safe area item location tracking process according to one embodiment of the present invention.

FIG. 6 is an operational flow diagram showing a safe area item location tracking process according to one embodiment of the present invention. The operational flow diagram of FIG. 6 shows an overall process of how the hub 102 sounds an alarm to indicate to a user of hub 102 that an electronic marker is out of range, while taking a safe area into account. A safe area is an area where a user is not concerned with leaving behind an item 116. Examples of a safe area are a user's home, a user's work office and a user's friend's house. The operational flow diagram of FIG. 6 begins with step 602 and flows directly to step 603.

In step 603, the hub 102 and the electronic marker 106 are logically coupled. In step 604, the hub 102 moves relative to the electronic marker 106. That is, the hub 102 moves separate from the electronic marker 106. In this case, the user of the hub 102 has moved with the hub 102 but has not picked up the electronic marker 106.

In step 606, the hub 102 determines whether the distance between the electronic marker 106 and the hub 102 is greater than a threshold. If the distance between the electronic marker 106 and the hub 102 is not greater than a threshold, then control flows back to step 604. If the distance between the electronic marker 106 and the hub 102 is greater than a threshold, then control flows to step 608.

In step 608, the hub 102 determines whether the electronic marker 106 was left in the safe area. The hub 102 is able to determine whether the electronic marker 106 was left in a safe area because the user has previously defined a safe area and the location module 230 of the hub 102 is able to determine the current location of the hub 102. If the electronic marker 106 was left in the safe area, then control flows back to step 604. If the electronic marker 106 was not left in the safe area, then control flows to step 610.

In step 610, the hub 102 initiates an alarm to indicate to the user of the hub 102 that the electronic marker 106 is too far away from the hub 102. The alarm may be an audible alarm, a tactile alarm such as a vibration mode, or a visual alarm such as a blinking light. In step 612, the control flow of FIG. 6 stops.

Figure 7:
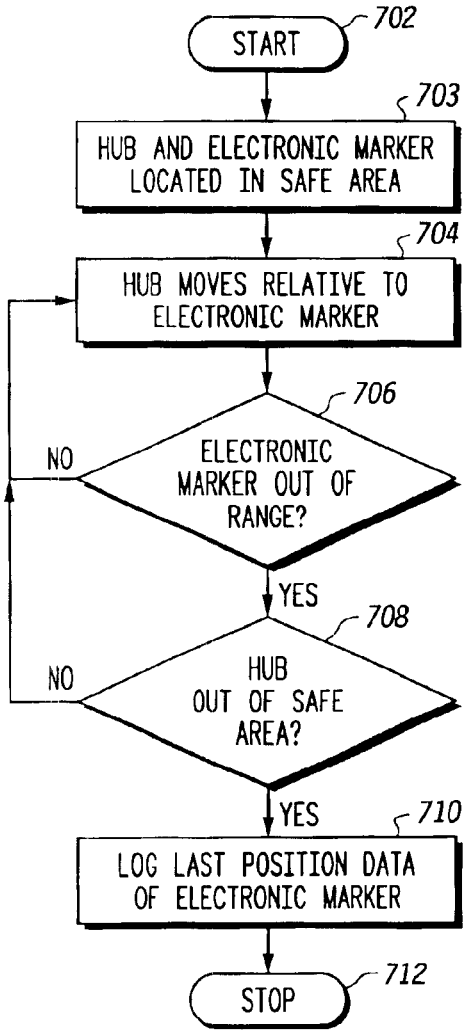
FIG. 7 is an operational flow diagram showing a passive item location tracking process according to one embodiment of the present invention.

FIG. 7 is an operational flow diagram showing a passive item location tracking process according to one embodiment of the present invention. The operational flow diagram of FIG. 7 shows an overall process of how the hub 102 informs a user of hub 102 that an electronic marker is out of range, while acting passively. A safe area is an area where a user is not concerned with leaving behind an item 116. Examples of a safe area are a user's home, a user's work office and a user's friend's house. The operational flow diagram of FIG. 7 begins with step 702 and flows directly to step 703.

In step 703, the hub 102 and the electronic marker 106 are located close together.

In step 704, the hub 102 moves relative to the electronic marker 106. That is, the hub 102 moves separate from the electronic marker 106. In this case, the user of the hub 102 has moved with the hub 102 but has not picked up the electronic marker 106. In step 706, the hub 102 determines whether the electronic marker 106 is too far away from the hub 102. If the hub 102 is still receiving beacon information packets from the electronic marker 106, then the hub 102 is not too far away from the electronic marker 106 and control flows back to step 704. If the hub 102 is too far away from the electronic marker 106, control flows to step 708.

In step 708, the hub 102 determines whether the electronic marker 106 was left in the safe area. The hub 102 is able to determine whether the electronic marker 106 was left in a safe area because the user has previously defined a safe area and the location module 230 of the hub 102 is able to determine the current location of the hub 102. If the electronic marker 106 was left in the safe area, then control flows back to step 704. If the electronic marker 106 was not left in the safe area, then control flows to step 710.

In step 710, the hub 102 logs the last position data of the electronic marker 106 before the electronic marker 106 was too far away from the hub 102. This information is stored in the storage module 214 of hub 102 and can be recalled later in order to determine the last known location of the electronic marker 106. In step 712, the control flow of FIG. 7 stops.

In one embodiment of the present invention, steps 703 and 708 are eliminated from the control flow of FIG. 7. In this embodiment, the concept of the safe area is not taken into account when the hub 102 determines whether to log the position data of the electronic marker 106.

Figure 8:
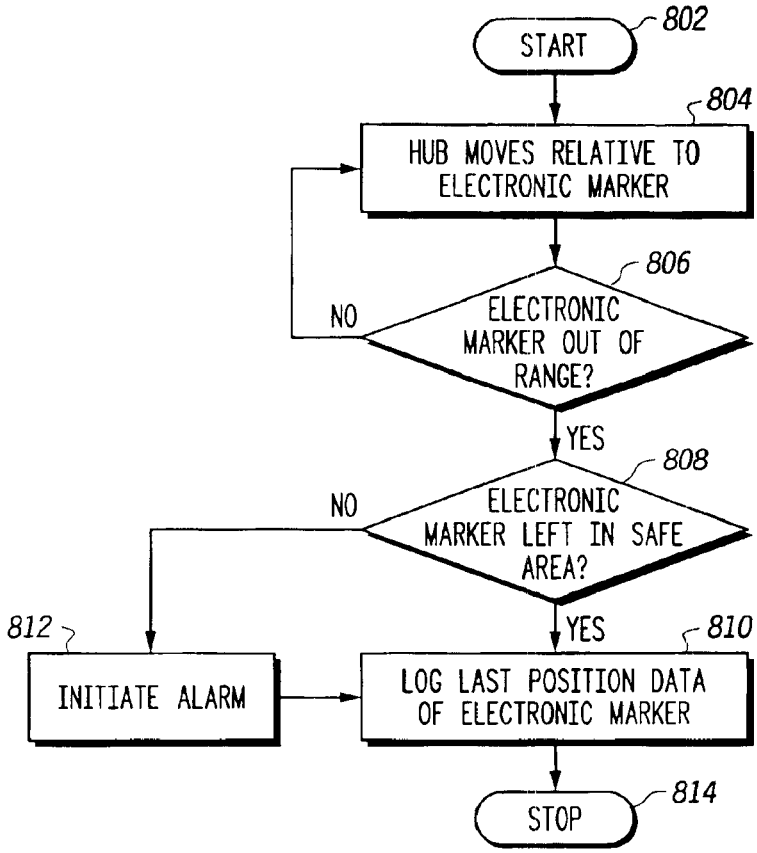
FIG. 8 is an operational flow diagram showing a toggling active/passive item location tracking process according to one embodiment of the present invention.

FIG. 8 is an operational flow diagram showing a toggling active/passive item location tracking process according to one embodiment of the present invention. The operational flow diagram of FIG. 8 shows an overall process of how the hub 102 informs a user of hub 102 that an electronic marker is out of range, while acting actively or passively depending on the location of the hub 102. The operational flow diagram of FIG. 8 begins with step 802 and flows directly to step 804.

In step 804, the hub 102 moves relative to the electronic marker 106. That is, the hub 102 moves separate from the electronic marker 106. In this case, the user of the hub 102 has moved with the hub 102 but has not picked up the electronic marker 106. In step 806, the hub 102 determines whether the electronic marker 106 is within range of the hub 102. If the hub 102 is still receiving beacon information packets from the electronic marker 106, then the hub 102 is still within range of the electronic marker 106 and control flows back to step 804. If the hub 102 is not receiving beacon information packets from the electronic marker 106, then the hub 102 is not within range of the electronic marker 106 and control flows to step 808.

In step 808, the hub 102 determines whether the electronic marker 106 was left in the safe area. The hub 102 accomplishes this task by determining whether the hub 102 was located in the safe area during the last reception of a beacon information packet from the electronic marker 106. The hub 102 is able to determine whether it was located in a safe because the user has previously defined a safe area and the location module 230 of the hub 102 is able to determine the current location of the hub 102. If the electronic marker 106 was left in the safe area, then control flows to step 810. If the electronic marker 106 was not left in the safe area, then control flows to step 812.

In step 810, the hub 102 logs the last position data of the electronic marker 106 before it went out of range. This information is stored in the storage module 214 of hub 102 and can be recalled later in order to determine the last known location of the electronic marker 106. In step 812, the hub 102 initiates an alarm to indicate to the user of the hub 102 that the electronic marker 106 is out of range of the hub 102. The alarm may be an audible alarm, a tactile alarm such as a vibration mode, or a visual alarm such as a blinking light. In step 814, the control flow of FIG. 8 stops.

Figure 9:
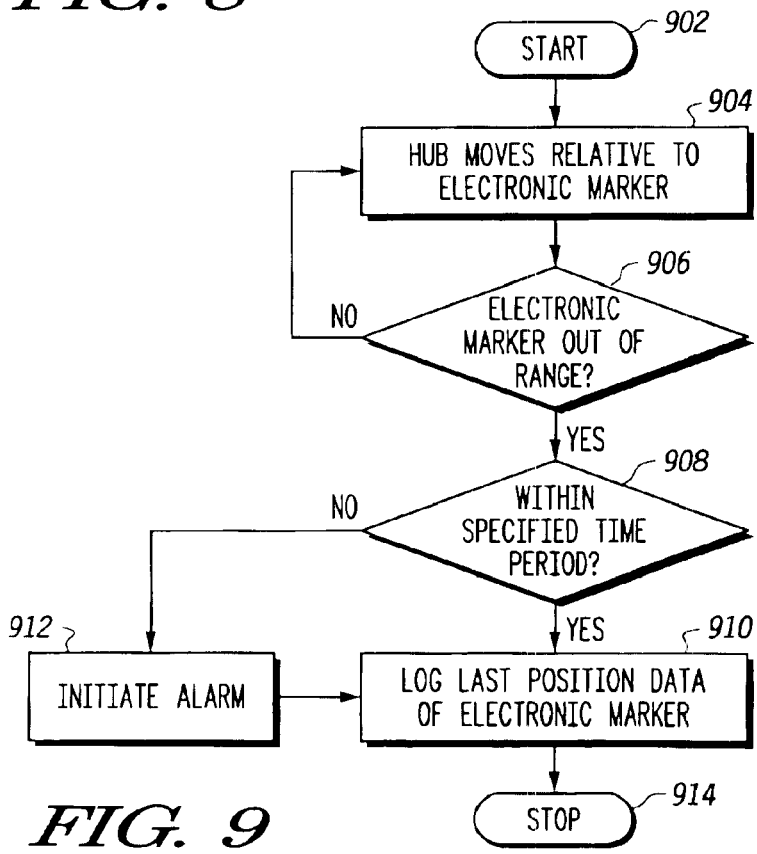
FIG. 9 is an operational flow diagram showing a schedule-based item location tracking process according to one embodiment of the present invention.

FIG. 9 is an operational flow diagram showing a schedule-based item location tracking process according to one embodiment of the present invention. The operational flow diagram of FIG. 9 shows an overall process of how the hub 102 informs a user of hub 102 that an electronic marker is out of range, while taking into account schedule-based information. The operational flow diagram of FIG. 9 begins with step 902 and flows directly to step 904.

In step 904, the hub 102 moves relative to the electronic marker 106. That is, the hub 102 moves separate from the electronic marker 106. In this case, the user of the hub 102 has moved with the hub 102 but has not picked up the electronic marker 106. In step 906, the hub 102 determines whether the electronic marker 106 is within range of the hub 102. If the hub 102 is still receiving beacon information packets from the electronic marker 106, then the hub 102 is still within range of the electronic marker 106 and control flows back to step 904. If the hub 102 is not receiving beacon information packets from the electronic marker 106, then the hub 102 is not within range of the electronic marker 106 and control flows to step 908.

In step 908, the hub 102 determines whether the current time is within a predefined period of time (stored on storage module 214, for example). For example, the hub 102 determines whether the current time is within the hours of 9 am and 5 pm on a weekday. This exemplary period of time is a typical period of time when a user may not want to be bothered with alarms pertaining to electronic markers going out of range. The hub 102 accomplishes this task by determining whether the current time, or the time of its internal clock, is within the predefined period of time. If the current time is within the predefined period of time, then control flows to step 910. If the current time is not within the predefined period of time, then control flows to step 912.

In step 910, the hub 102 logs the last position data of the electronic marker 106 before it went out of range. This information is stored in the storage module 214 of hub 102 and can be recalled later in order to determine the last known location of the electronic marker 106. In step 912, the hub 102 initiates an alarm to indicate to the user of the hub 102 that the electronic marker 106 is out of range of the hub 102. The alarm may be an audible alarm, a tactile alarm such as a vibration mode, or a visual alarm such as a blinking light. In step 914, the control flow of FIG. 9 stops.

Figure 10:
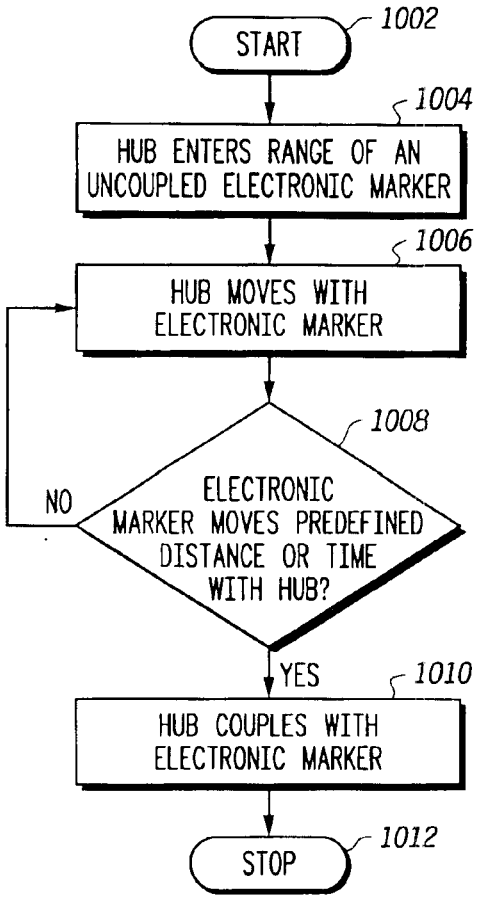
FIG. 10 is an operational flow diagram showing a motion-based coupling, item location tracking process according to one embodiment of the present invention.

FIG. 10 is an operational flow diagram showing a motion-based coupling, item location tracking process according to one embodiment of the present invention. The operational flow diagram of FIG. 10 shows an overall process of how the hub 102 couples to an electronic marker 106 using motion. The operational flow diagram of FIG. 10 begins with step 1002 and flows directly to step 1004.

In step 1004, the hub 102 enters the radio range of an electronic marker 106 to which it is not coupled. The hub 102 enters the range of electronic marker when the hub 102 is able to receive beacon information packets from the electronic marker. An electronic marker 106 is considered coupled to the hub 102 when it is determined that a user desires to travel or move with the electronic marker and does not want to be separated from or lose the electronic marker.

In step 1006, the hub 102 moves with the electronic marker 106. In this case, the user of the hub 102 has picked up the electronic marker 106 and has started to move with it. In step 1008, the hub 102 determines whether the electronic marker 106 has moved a predefined distance or a predefined time with hub 102. The predefined distance or the predefined time can be stored in storage module 214 of the hub 102. The hub 102 determines the amount of time the electronic marker 106 has traveled with the hub 102 by starting a timer when the electronic marker 106 comes into range of the hub 102. The hub 102 determines the distance the electronic marker 106 has traveled with the hub 102 by calculating the distance between the current location of the hub 102 and the location of the hub 102 when the electronic marker 106 comes into range of the hub 102. If the electronic marker 106 has not moved the predefined distance or the predefined time with hub 102, control flows back to step 1006. If the electronic marker 106 has moved the predefined distance or the predefined time with hub 102, control flows to step 1010.

In step 1010, the hub 102 couples with the electronic marker 106. In step 1012, the control flow of FIG. 10 stops.

Figure 11:
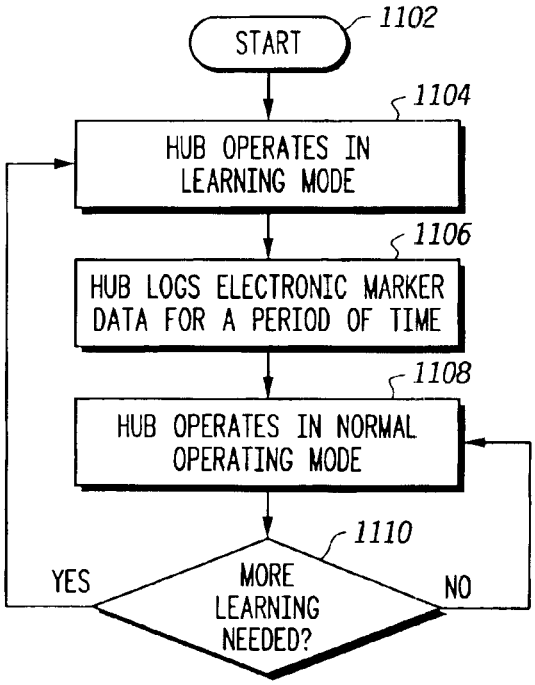
FIG. 11 is an operational flow diagram showing a learning process for an item location tracking process according to one embodiment of the present invention.

FIG. 11 is an operational flow diagram showing a learning process for an item location tracking process according to one embodiment of the present invention. The operational flow diagram of FIG. 11 shows an overall process of how the hub 102 automatically learns to track items, alarm the user of items gone out of range and couple to electronic markers. The operational flow diagram of FIG. 11 begins with step 1102 and flows directly to step 1104.

In step 1104, the hub 102 is placed in a learning mode. This typically occurs upon first use or upon resetting of the configuration of the hub 102. The learning mode indicates to the hub 102 that it must log item location information and coupling information for a period of time in order to learn the habits of the user. In step 1106, the hub 102 proceeds to log item location information and coupling information for a period of time. In step 1106, the hub 102 proceeds to learn safe area information, schedule information and coupling information. In one embodiment, the information learned during the learning step 1106 can be stored in the storage module 214 (in the profile 215, for example) of the hub 102.

After a period of time, the learning mode of the hub 102 expires and the hub 102 enters normal operating mode in step 1108. Alternatively, the hub 102 enters normal operating mode by prompting the user. In step 1110, it is determined whether mode learning is needed by the item location tracking system of the present invention. In one embodiment, the user indicates that the hub 102 requires more learning before entering normal operating mode. In another embodiment, the hub 102 determines from the number of corrections or other modification made by the user that the hub 102 requires more learning before entering into normal operating mode. If the hub 102 requires more learning, control flows back to step 1104. If the hub 102 does not require more learning, control flows back to step 1108 as the hub 102 continues to operate in normal operating mode.

In an embodiment of the present invention, a user of the hub 102 may employ a find feature in order to find an item (coupled with an electronic marker) that has been lost. The aforementioned find feature employs the use of electronic marker location data that has been stored by hub 102 previously, such as in steps 710, 810 and 910 of FIGS. 7, 8 and 9, respectively. When the find feature has been activated, the hub 102 accesses the electronic marker location data, which has been stored previously, corresponding to the lost electronic marker. The retrieved electronic marker location data defines the last place or places where the lost electronic marker was located last. Using this information, the user of hub 102 can increase his chances of locating the lost item.

In another embodiment of the present invention, a user of the hub 102 may employ a cooperative find feature in order to find an item (coupled with an electronic marker) that has been lost. The cooperative find feature takes advantage of the presence of more than one item location tracking system, as described in FIG. 1. That is, the cooperative find feature employs the resources of more than one hub 102. The cooperative find feature assumes that more than one hub of a plurality of hubs sense multiple electronic markers (not just those coupled to the hub) and store their respective location data when they come into range.

The cooperative find feature uses electronic marker location data that has been stored by a plurality of hubs previously, such as in steps 710, 810 and 910 of FIGS. 7, 8 and 9, respectively. When the cooperative find feature has been activated, the plurality of hubs accesses the electronic marker location data, which has been stored previously, corresponding to the lost electronic marker. The retrieved electronic marker location data is communicated amongst the hubs and defines the last place or places where the lost electronic marker was located last. Using this information, the user can increase his chances of locating the lost item.

The present invention can be realized in hardware, software, or a combination of hardware and software on the hub 102, the electronic markers 106 through 108 or any combination of the two. A system according to a preferred embodiment of the present invention can be realized in a centralized fashion in one information processing system, or in a distributed fashion where different elements are spread across several interconnected systems. Any kind of information processing system—or other apparatus adapted for carrying out the methods described herein—is suited. A typical combination of hardware and software could be a general-purpose computer system with a computer program that, when loaded and executed, controls the computer system such that it carries out the methods described herein.

An embodiment of the present invention can also be embedded in a computer program product that includes all the features enabling the implementation of the methods described herein, and which, when loaded in a system, is able to carry out these methods. Computer program means or computer program as used in the present invention indicates any expression, in any language, code or notation, of a set of instructions intended to cause a system having an information processing capability to perform a particular function either directly or after either or both of the following a) conversion to another language, code or, notation; and b) reproduction in a different material form.

A system may include, inter alia, one or more information processing systems and/or computers and at least a machine-readable or computer-readable medium, allowing a system, to read data, instructions, messages or message packets, and other information from the machine-readable or computer-readable medium. The machine-readable or computer-readable medium may include non-volatile memory, such as ROM, Flash memory, Disk drive memory, CD-ROM, and other permanent storage. Additionally, a machine-readable or computer-readable medium may include, for example, volatile storage such as RAM, buffers, cache memory, and network circuits. Furthermore, the machine-readable or computer-readable medium may include information in a transitory state medium such as a network link and/or a network interface, including a wired network or a wireless network, that allow a computer system to read such computer-readable information.

FIG. 12 is a block diagram of a computer system useful for implementing an embodiment of the present invention. The computer system of FIG. 12 includes multiple processors, such as processors 1204. The processors 1204 are connected to a communication infrastructure 1202 (e.g., a communications bus, cross-over bar, or network). At least one cache (not shown) is also connected to the communication infrastructure 1202. Various software embodiments are described in terms of this exemplary computer system. After reading this description, it will become apparent to a person of ordinary skill in the relevant art(s) how to implement the invention using other computer systems and/or computer architectures.

The computer system can include a display interface 1208 that forwards graphics, text, and other data from the communication infrastructure 1202 (or from a frame buffer not shown) for display on the display unit 1210. The computer system also includes a main memory 1206, preferably random access memory (RAM), and may also include a secondary memory 1212. The secondary memory 1212 may include, for example, a hard disk drive 1214 and/or a removable storage drive 1216, representing a floppy disk drive, a magnetic tape drive, an optical disk drive, etc. The removable storage drive 1216 reads from and/or writes to a removable storage unit 1218 in a manner well known to those having ordinary skill in the art. Removable storage unit 1218, represents a floppy disk, magnetic tape, optical disk, etc., which is read by and written to by removable storage drive 1216. As will be appreciated, the removable storage unit 1218 includes a computer usable storage medium having stored therein computer software and/or data.

In alternative embodiments, the secondary memory 1212 may include other similar means for allowing computer programs or other instructions to be loaded into the computer system. Such means may include, for example, a removable storage unit 1222 and an interface 1220. Examples of such may include a program cartridge and cartridge interface (such as that found in video game devices), a removable memory chip (such as an EPROM, or PROM) and associated socket, and other removable storage units 1222 and interfaces 1220 which allow software and data to be transferred from the removable storage unit 1222 to the computer system.

The computer system may also include a communications interface 1224. Communications interface 1224 allows software and data to be transferred between the computer system and external devices. Examples of communications interface 1224 may include a modem, a network interface (such as an Ethernet card), a communications port, a PCMCIA slot and card, etc. Software and data transferred via communications interface 1224 are in the form of signals which may be, for example, electronic, electromagnetic, optical, or other signals capable of being received by communications interface 1224. These signals are provided to communications interface 1224 via a communications path (i.e., channel) 1226. This channel 1226 carries signals and may be implemented using wire or cable, fiber optics, a telephone line, a cellular telephone link, an RF link, and/or other communications channels.

In this document, the terms "computer program medium," "computer-usable medium," "machine-readable medium" and "computer-readable medium" are used to generally refer to media such as main memory 1206 and secondary memory 1212, removable storage drive 1216, a hard disk installed in hard disk drive 1214, and signals. These computer program products are means for providing software to the computer system. The computer-readable medium allows the computer system to read data, instructions, messages or message packets, and other computer-readable information from the computer-readable medium. The computer-readable medium, for example, may include non-volatile memory, such as Floppy, ROM, Flash memory, Disk drive memory, CD-ROM, and other permanent storage. It is useful, for example, for transporting information, such as data and computer instructions, between computer systems. Furthermore, the computer-readable medium may include computer-readable information in a transitory state medium such as a network link and/or a network interface, including a wired network or a wireless network, that allow a computer to read such computer-readable information.

Computer programs (also called computer control logic) are stored in main memory 1206 and/or secondary memory 1212. Computer programs may also be received via communications interface 1224. Such computer programs, when executed, enable the computer system to perform the features of the present invention as discussed herein. In particular, the computer programs, when executed, enable the processor 1204 to perform the features of the computer system. Accordingly, such computer programs represent controllers of the computer system.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

What is claimed is:

1. A device for tracking at least one item, comprising:

a location module for determining a location of a device;

a receiver connected to the device for receiving signals from at least one item;

location information for a predefined area;

a processor for determining whether the location of the device is within the predefined area by comparing the location to the location information for the predefined area and determining whether the at least one item is within a range of the device; and a storage module for storing the location of the device in response to determining that the at least one item is not within the range and that the location of the device is not within the predefined area.

2. The device of claim 1, wherein the device is any one of a mobile telephone, a mobile pager and a mobile communication system.

3. The device of claim 1, further comprising:

an alarm for indicating that the at least one item is not within the range.

4. The device of claim 2, wherein the device communicates with the at least one item using any one of:

the IEEE 802.15.4 communications standard;

the IEEE 802.11(b) communications standard; and the Bluetooth communications standard, and wherein the processor determines whether the at least one item is within a range of the device due to the receiver receiving a signal from the at least one item.

5. A system for tracking items, comprising:

at least one item, each item including:

a unique identifier;

a transmitter for transmitting the unique identifier; and a coupling element for coupling the item to an object; and a device including:

a location module for determining a location of the device;

a receiver connected to the device for receiving signals from the at least one item;

location information for a predefined area;

a processor for determining whether the location of the device is within the predefined area by comparing the location to the location information for the predefined area and determining whether the at least one item is within a range of the device; and a storage module for storing the location of the device in response to determining that the at least one item is not within the range and that the location of the device is not within the predefined area.

6. The system of claim 5, the device further comprising:

an alarm for indicating that the at least one item is not within the range.

7. The system of claim 5, wherein the device communicates with the at least one item using any one of:

the IEEE 802.15.4 communications standard;

the IEEE 802.11(b) communications standard; and the Bluetooth communications standard, and wherein the processor determines whether the at least one item is within a range of the device due to the receiver receiving a signal from the at least one item.

8. A system for tracking items, comprising;

at least one item, each item including:

a unique identifier:

a transmitter for transmitting the unique identifier; and a coupling element for coupling the item to an object; and at least one device, each device including:

a location module for determining a location of the device;

a receiver connected to the device for receiving signals from the at least one item;

location information for a predefined area;

a processor for determining whether the location of the device is within the predefined area by comparing the location to the location information for the predefined area and determining whether the at least one item is within a range of the device; and a storage module for storing the location of the device in response to determining that the at least one item is not within the range and that the location of the device is not within the predefined area.

9. The system of claim 8, wherein the at least one device is any one of a mobile telephone, a mobile pager, a messaging device, and a mobile communication system.

10. The system of claim 8, wherein each of the at least one device further comprises:

an alarm for indicating that the at least one item is not within the range.

11. The system of claim 8, wherein the processor of each of the at least one device, in response to a user request, further retrieves location information from the storage module in at least one of the at least one device, so as to find the last stored location of the at least one item.

12. A method on a device for tracking at least one item, the method comprising:

determining a location of the device;

determining whether the location of the device is within a predefined area by comparing the location to a specification of the predefined area;

determining whether at least one item is within a predetermined range of the device; and storing, in response to determining that the at least one item is not within the predetermined range and that the location, of the device is not within the predefined area, the location of the device.

13. The method of claim 12, wherein the device is any one of a mobile telephone, a mobile pager, wireless messaging device, and a mobile communication system.

14. The method of claim 12, further comprising:

performing a notification indicating that the at least one item is not within the range.

15. The method of claim 12, further comprising:

determining whether the current time is within a predefined time period; and storing, in response to determining that the current time is not within the predefined time period and that the at least one item is not within the predetermined range, the location of the device.

16. The method of claim 12, wherein the device communicates with the at least one item using any one of:

the IEEE 802.15.4 communications standard;

the IEEE 802.11(b) communications standard; and the Bluetooth communications standard, and wherein the determining whether at least one item is within a predetermined range of the device comprises receiving a signal from the at least one item.

17. A method on a device for tracking at least one item, the method comprising:

determining a location of the device;

detecting that the at least one item has come within a range of the device;

determining that the device is moving; and determining that the at least one item is moving within the range of the device while the device is moving.

18. The method of claim 17, further comprising:

determining whether the at least one item has moved within the range of the device for a predefined period of time; and setting a variable, in response to determining that the at least one item has moved within the range of the device for the predefined period of time, indicating that the at least one item is associated to the device.

19. The method of claim 17, further comprising:

determining whether the at least one item has moved within the range of the device while the device has moved a predefined distance; and setting a variable, in response to determining that the at least one item has moved within the range of the device for the predefined distance, indicating that the at least one item is attached to the device.

20. The method of claim 17, wherein the device is any one of a mobile telephone, a mobile pager and a mobile communication system.

21. The method of claim 17, wherein the device communicates with the at least one item using any one of:

the IEEE 802.15.4 communications standard;

the IEEE 802.11(b) communications standard; and the Bluetooth communications standard, and wherein the determining that the at least one item has come within a range of the device comprises receiving a signal communicated from the at least one item.

22. The method of claim 14, further comprising determining if the at least one item has not been left in the predefined area, and wherein performing the notification is performed in response to determining that the at least one item has not been left in the predefined area.

23. The method of claim 14, wherein performing the notification is selectively performed based upon a status indicator.

24. The method of claim 12, further comprising:

retrieving the stored location of the device; and communicating the location amongst at least one remote device.

* * * * *